United States Patent [19]

Sletten

[11] 4,141,014

[45] Feb. 20, 1979

[54] MULTIBAND HIGH FREQUENCY COMMUNICATION ANTENNA WITH ADJUSTABLE SLOT APERTURE

[75] Inventor: Carlyle J. Sletten, Acton, Mass.

[73] Assignee: The United States of America as represented by the Secretary of the Air Force, Washington, D.C.

[21] Appl. No.: 826,083

[22] Filed: Aug. 19, 1977

[51] Int. Cl.[2] ..... H01Q 13/12

[52] U.S. Cl. ..... 343/768; 343/874

[58] Field of Search ..... 343/767, 768, 770, 771, 343/874

[56] References Cited

U.S. PATENT DOCUMENTS

| | | | |
|---|---|---|---|
| 2,600,179 | 6/1952 | Alford | 343/767 |
| 2,794,184 | 5/1957 | Kolar et al. | 343/767 |
| 2,807,019 | 9/1957 | Darling | 343/767 |
| 2,960,694 | 11/1960 | Serniuk | 343/768 |

*Primary Examiner*—Eli Lieberman

*Attorney, Agent, or Firm*—Joseph E. Rusz; Willard R. Matthews, Jr.

[57] ABSTRACT

A portable multiband H.F. antenna that has minimum ground area requirements and that is capable of transmitting electromagnetic wave radiation with horizontal polarization, azimuth plane omnidirectional patterns and a null in the vertical beam pattern is realized by means of an easily erectable tower type radiator. The tower structure has adjacent conductive leg members that define an elongated antenna slot aperture the total length of which is resonant to the lowest operating frequency band. A microwave transmission line resides along one side of the slot and the slot aperture is fed by shorting the transmission line to the oposite side of the slot. Operation at higher frequency bands is achieved by shorting out sections of the slot aperture on both sides of the feed. An array of radiating slot apertures can be provided by shorting the full slot aperture into sections and feeding each slot section separately. The addition of capacitance to the feed circuit permits operation at frequency bands below that provided for by the full slot aperture length.

2 Claims, 4 Drawing Figures

MULTIBAND HIGH FREQUENCY COMMUNICATION ANTENNA WITH ADJUSTABLE SLOT APERTURE

STATEMENT OF GOVERNMENT INTEREST

The invention described herein may be manufactured and used by or for the Government for governmental purposes without the payment of any royalty thereon.

BACKGROUND OF THE INVENTION

The invention relates to high frequency communication antennas, and in particular to a portable, field erectable antenna that requires only a small land area to deploy.

These tactically deployable antennas can be used to advantage in both military and commercial applications. In addition to the semi-mobile use for advanced bases and deployed personnel antennas of this type can be used at permanent broadcasting stations and military bases. In general the specification for antennas of this type call for horizontal polarization, E-plane omnidirectional patterns, guaranteed nulls in the zenith direction to reduce multipath and physical dimensions that limit the structure to less than 150 feet in height and minimum ground area.

The state-of-the-art approach to providing such an antenna has centered on a stack or turnstyle of crossed dipoles mounted horizontally over the earth. Such a system of wires has conformation like a log-periodic antenna with higher frequency band dipole near the earth and lower frequency dipole highest above ground. The main difficulty with this type of antenna is the very large ground area needed to deploy the antenna. Also the height gain of the antenna in the 7–30 MHz region is low and the null at the higher frequencies (2–5 MHz) is hard to maintain at zenith.

Accordingly, there currently exists the need for an antenna that meets the above enumerated electrical specifications and that is structurally easy to manipulate and takes up minimum ground space. The present invention is directed toward providing an antenna that achieves that end and that further provides other improved electrical and structural characteristics.

SUMMARY OF THE INVENTION

The invention comprehends a tower-type antenna in which the inner conductive structural members of two tower legs define the elongated vertical sides of an antenna slot aperture. Conductive connecting members at the bottom and top of the structure complete the slot aperture for the low frequency band. A coaxial cable feed resides along one of the aperture defining inner tower leg structural members. The slot aperture is fed by shorting the center conductor of the coaxial cable to the opposite side of the slot aperture. Higher frequency band operation is achieved by short circuiting, by means of shorting rods, appropriate portions of the apertures on both sides of the feed. The short circuiting rods have three positions: open circuit; short circuit to the coaxial cable center conductor; and, short circuit to the opposite side of the aperture. Mechanical manipulation of the short circuiting rods permits switching to any of a multiplicity of operating frequency bands. Various aperture arrays can also be formed by proper switching action. Operation at frequency bands below the band provided for by the longest slot aperture dimension is accomplished by adding capacitance to the feed circuit.

It is a principal object of the invention to provide a new and improved multiband high frequency communication antenna.

It is another object of the invention to provide a portable multiband high frequency communication antenna that is structurally easy to manipulate and takes up minimum ground space.

It is another object of the invention to provide a tactically deployable high frequency multiband communication antenna that is capable of horizontal polarization and azimuth plane omnidirectional patterns and that provides guaranteed nulls in the azimuth beam direction.

It is another object of the invention to provide a tactically deployable multiband antenna as the type described having improved height gain at higher frequencies.

These, together with other objects, features and advantages of the invention, will become more readily apparent from the following detailed description when taken in conjunction with the illustrative embodiment in the accompanying drawings.

DETAILED DESCRIPTION OF THE PREFERRED EMBODIMENT

Figure 1:
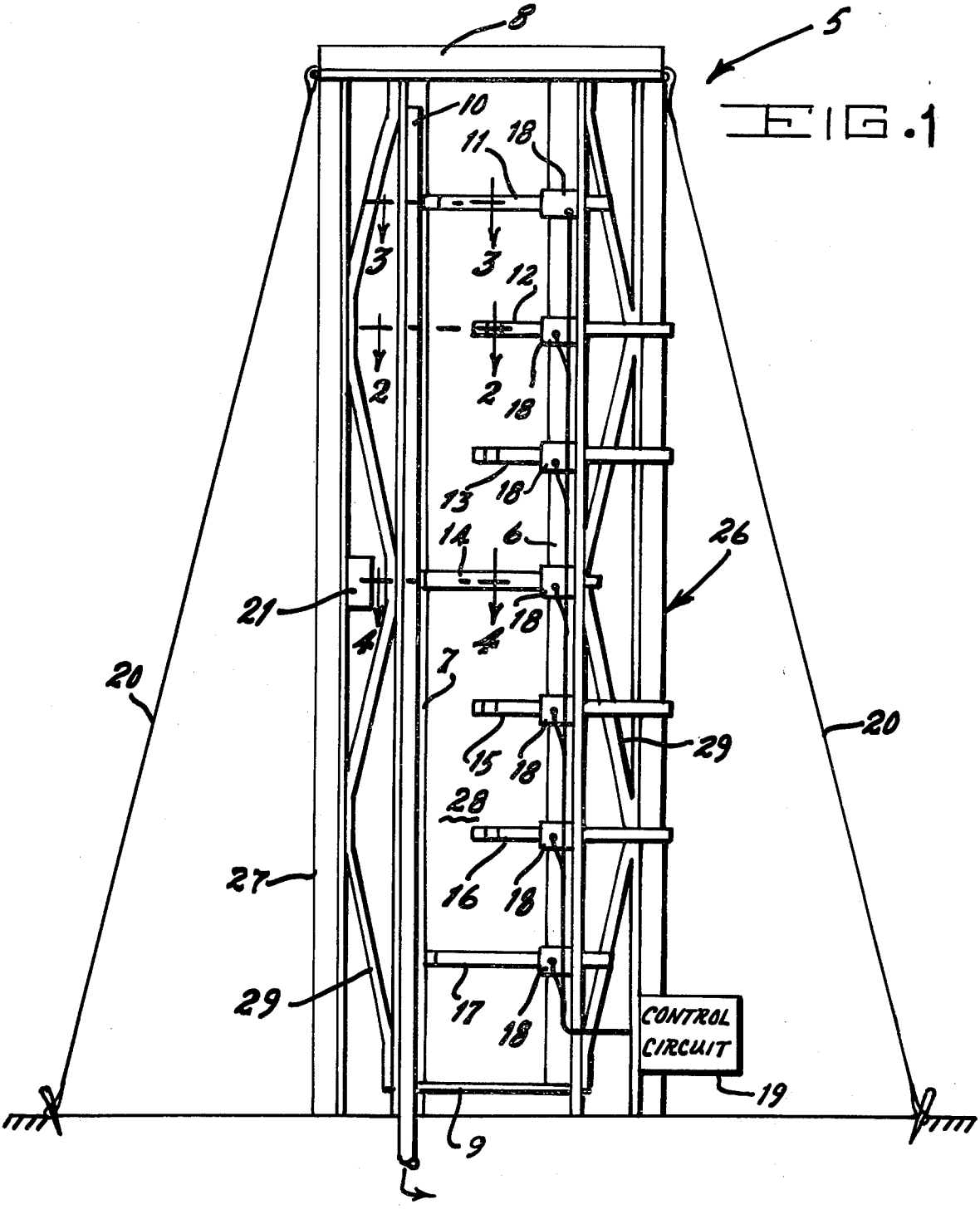
FIG. 1 is an elevational view of one presently preferred embodiment of the antenna of the invention.

The basic concept of the antenna comprehended by the invention resides in the use of one skeleton slot setting vertically over the ground as shown in FIG. 1. Motor or solenoid actuated rods mechanically adjust the dimensions of slots to resonancy ($\frac{1}{4}\lambda$) a new band operations are required. At the lower frequencies capacity (low loss) can be used to match shorter slots. As noted above the advantages of the antenna are: very little ground area is required; cost is less (only two poles or towers are necessary); and, the structure is easy to erect, operate and maintain.

Figure 2:
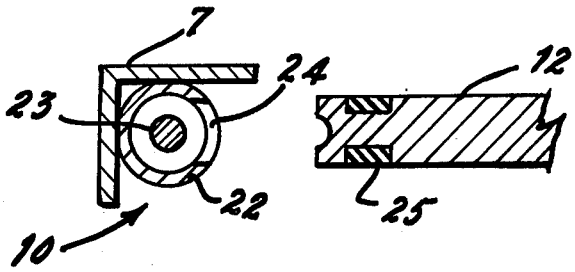
FIG. 2 is a sectional view of the antenna of FIG. 1 taken at 2—2.
Figure 3:
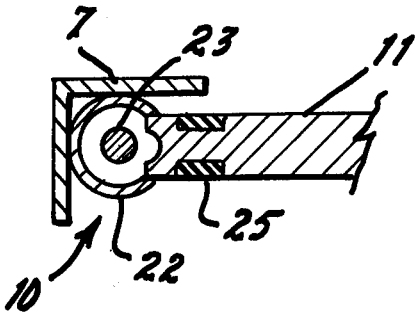
FIG. 3 is a sectional view of the antenna of FIG. 1 taken at 3—3.
Figure 4:
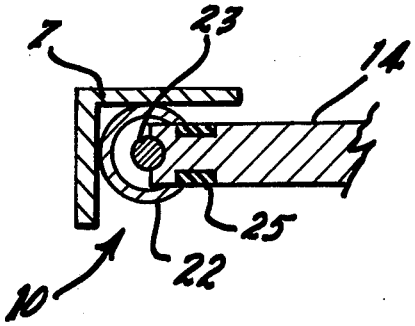
FIG. 4 is a sectional view of the antenna of FIG. 1 taken at 4—4.

Referring now to FIGS. 1–4, the tower type antenna 5 of the invention comprises first and second tower legs 26, 27, connecting members 8, 9, structural support member 29 and guys 20. The inner structural members 6, 7 of tower legs 26, 27 are constructed of electrically conductive material (aluminum angle or the like) and define the sides of slot aperture 28. Connecting members 8, 9 are also of electrically conductive material and define the ends of slot aperture 28. The dimensions of slot aperture 28 are determined by the lowest frequency band of operation. Lower frequency band operation, however, can be achieved by means of the addition of capacitance to the feed circuit in a manner hereinafter described. A microwave transmission line such as coaxial cable 10 carries the antenna feed signal and is disposed along the entire length of one tower leg inner structural member (member 7 of FIG. 1). The slot aperture is fed by shorting the center conductor 23 of the coaxial cable to the opposite side of the aperture. This is accomplished in the example of FIG. 1 by means of shorting rod 14. The tower structure of the invention also includes a multiplicity of other shorting rods (rods 11–17 of FIG. 1) that can be used either for shorting out portions of the slot aperture to control bandwidth or for providing feeds for one or more slot apertures. The shorting rods thus have three possible positions: open circuit position (rods 12, 13, 15 and 16); short circuit between sides of the slot aperture (rods 11 and 17); and, short circuit between a side of the slot aperture and the coaxial cable center conductor (rod 14). Any rod can be placed in any position by applicable mechanical means and control circuits. For instance, the three-stage solenoids 18 controlled by control circuit 19 disclosed by FIG. 1 could accomplish the desired rod control. Alternatively, individual motors could replace the three-stage solenoids. Also, a single motor located at the base of the tower structure coupled to a mechanical clutch mechanism could be used. Rods 11–17 must be electrically connected to tower leg structural member 6. This can be accomplished by a sliding contact through the flange of member 6 or by bonding with a flexible wire or by other means. Shorting rods 11–17 can be arranged to operate in all three positions by any convenient means. FIGS. 2–4 illustrate one such means. In this arrangement the coaxial cable auto sheath 22 is grounded and bonded to conductive structural member 7. It has openings 24 in the sheath 22 that are in register with the shorting rods. The shorting rods each have a ring of insulating material 25 near the end that contacts the coaxial cable.

FIGS. 2, 3 and 4 illustrate open circuit, short circuit to the opposite side of the slot apertures and short circuit to the coaxial cable center conductor positions, respectively.

By way of example, for a 2–30 MHz band device resonant sections of slot can be used for bands from 30 to 4 MHz. The 30 MHz slot for example can be at top (100 + feet) of the long slot by isolating with shorts the $\lambda/2$ section desired. For instance, the feeding of the 30 MHz slot will be through coaxial line 10 running along one of the two towers as shown on FIG. 1. The inner conductor of the coaxial line can be used to feed the slot. At the lowest frequency, say 4 MHz, where the (slot) antenna is about $\frac{1}{2}\lambda$ long the center shorting rod is used as center conductor for the feeding coaxial line. All other shorting rods would be retracted. At frequencies below 4 MHz the slot impedance becomes inductive and a capacitive matching network 21 is switched in the tune slot over operating bands in 4–2 MHz range. The height gain of the antenna in the 2–4 MHz is very good and the matching by parallel capacitance is less lossy than by inductors needed for short electric dipoles. The number of relay or motor actuated feeds and shorts is determined by the number of separate bands desired and by the bandwidth of the skeleton slot.

To increase the gain at higher frequencies (say, between 15 and 30 MHz) two or more slots can be excited in phase to provide a colinear array with more gain in elevation plane. In any case, the higher frequency slots should be positioned near the top of the tower to give as much height gain as possible.

While the invention has been described in one presently preferred embodiment, it is understood that the words which have been used are words of description rather than words of limitation, and that changes within the purview of the appended claims may be made without departing from the scope and spirit of the invention in its broader aspects.

What is claimed is:

1. A multiband high frequency communication antenna comprising a tower structure, a high frequency antenna slot aperture therein defined by electrically conductive portions thereof, short circuiting means for selectively short circuiting portions of said slot aperture, and an antenna feed circuit for feeding electromagnetic wave energy to said slot aperture and to slot apertures defined by said short circuiting means, said antenna feed circuit comprising an electromagnetic wave transmission line disposed along and electrically insulated from a first edge of said slot aperture, and said short circuiting means comprising a multiplicity of short circuiting elements in movable electrical connection with the edge of said slot aperture opposite said first edge, each said element having an open circuit position, a short circuit to said first edge position and a short circuit to said transmission line position, and means for selectively and individually controlling the positions of said elements.

2. A multiband high frequency communication antenna as defined in claim 1 including means for selectively adding capacitance to said antenna feed circuit.

* * * * *